United States Patent [19]

Beverly

[11] Patent Number: 4,460,123

[45] Date of Patent: Jul. 17, 1984

[54] APPARATUS AND METHOD FOR CONTROLLING THE TEMPERATURE OF A SPACE

[75] Inventor: John P. Beverly, East Aurora, N.Y.

[73] Assignee: Roberts-Gordon Appliance Corp., Buffalo, N.Y.

[21] Appl. No.: 542,771

[22] Filed: Oct. 17, 1983

[51] Int. Cl.[3] ..... F23N 5/20; F25B 19/00

[52] U.S. Cl. ..... 236/46 R; 62/231

[58] Field of Search ..... 236/46 R, 10, 11, 46 F; 165/12; 62/231

[56] References Cited

U.S. PATENT DOCUMENTS

| | | | |
|---|---|---|---|
| 2,495,844 | 1/1950 | Hornfeck | 236/46 R |
| 2,545,206 | 3/1951 | Main | 236/91 |
| 3,311,303 | 3/1967 | Noyes | 236/46 R |
| 3,428,250 | 2/1969 | Holthausen | 236/15 |
| 3,443,121 | 5/1969 | Weisbrod | 307/117 |
| 3,709,289 | 1/1973 | Weatherston | 165/12 |
| 3,912,913 | 10/1975 | Bunting | 236/46 R X |
| 3,933,197 | 1/1976 | Zimmer | 165/2 |
| 3,942,718 | 3/1976 | Palmieri | 236/78 R |
| 4,071,745 | 1/1978 | Hall | 236/46 R X |
| 4,110,827 | 8/1978 | Shavit | 165/22 X |
| 4,156,350 | 5/1979 | Elliott et al. | 62/80 |
| 4,172,555 | 10/1979 | Levine | 236/46 R |
| 4,193,006 | 3/1980 | Kabat et al. | 307/117 |
| 4,196,356 | 4/1980 | Kabat | 307/117 |
| 4,199,023 | 4/1980 | Phillips | 165/12 |
| 4,234,927 | 11/1980 | First | 364/557 |
| 4,270,693 | 6/1981 | Hayes | 236/46 F |
| 4,292,813 | 10/1981 | Paddock | 62/158 |
| 4,298,946 | 11/1981 | Hartsell et al. | 364/557 |
| 4,332,352 | 6/1982 | Jaeger | 236/1 E |
| 4,333,519 | 6/1982 | Shafrir et al. | 165/12 |
| 4,338,791 | 7/1982 | Stamp, Jr. et al. | 62/160 |
| 4,347,974 | 9/1982 | Pinckaers et al. | 236/46 R |
| 4,356,962 | 11/1982 | Levine | 236/46 F |
| 4,393,662 | 7/1983 | Dirth | 236/46 F |
| 4,407,138 | 10/1983 | Mueller | 62/126 |
| 4,407,446 | 10/1983 | Iijima | 236/49 |

OTHER PUBLICATIONS

Enerscan, Solidyne Corp., 11/82.

*Primary Examiner*—William E. Wayner

*Attorney, Agent, or Firm*—Christel, Bean & Linihan

[57] ABSTRACT

A method and apparatus for controlling the temperature of a space. The actual heat load for a space under the conditions prevailing at a time is determined based upon information available to a temperature sensor. The average heating/cooling percentage rate for relatively short duty cycles is adjusted based on this information whereby the actual heating/cooling load during this duty cycle interval may be approximately matched. The percentage rate may be overridden in the event an abnormal temperature situation exists. The method and apparatus of this invention has particular application when utilized with radiant heaters.

21 Claims, 9 Drawing Figures

Fig. 4.

| DUTY CYCLE | | MINUTES OF "On Time" |
|---|---|---|
| CHANNEL | % ON TIME/10 MIN. | (10 MIN. DUTY CYCLE) |
| 1 | 100% | 10.0 MINS. |
| 2 | 95% | 9.5 MINS. |
| 3 | 85% | 8.5 MINS. |
| 4 | 75% | 7.5 MINS. |
| 5 | 65% | 6.5 MINS. |
| 6 | 55% | 5.5 MINS. |
| 7 | 45% | 4.5 MINS. |
| 8 | 35% | 3.5 MINS. |
| 9 | 25% | 2.5 MINS. |
| 10 | 15% | 1.5 MINS. |

Fig. 5A.
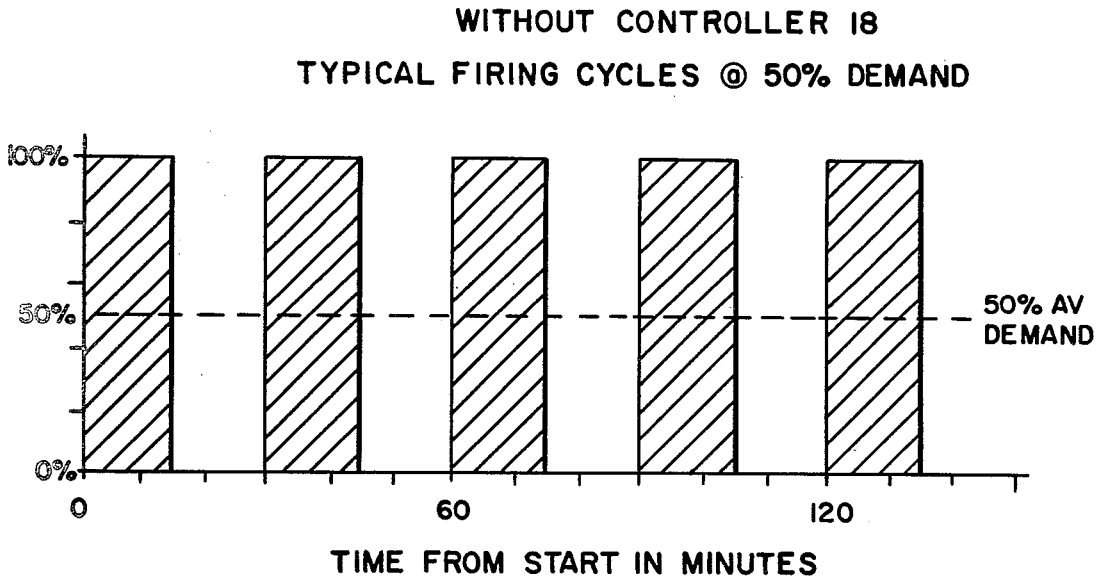
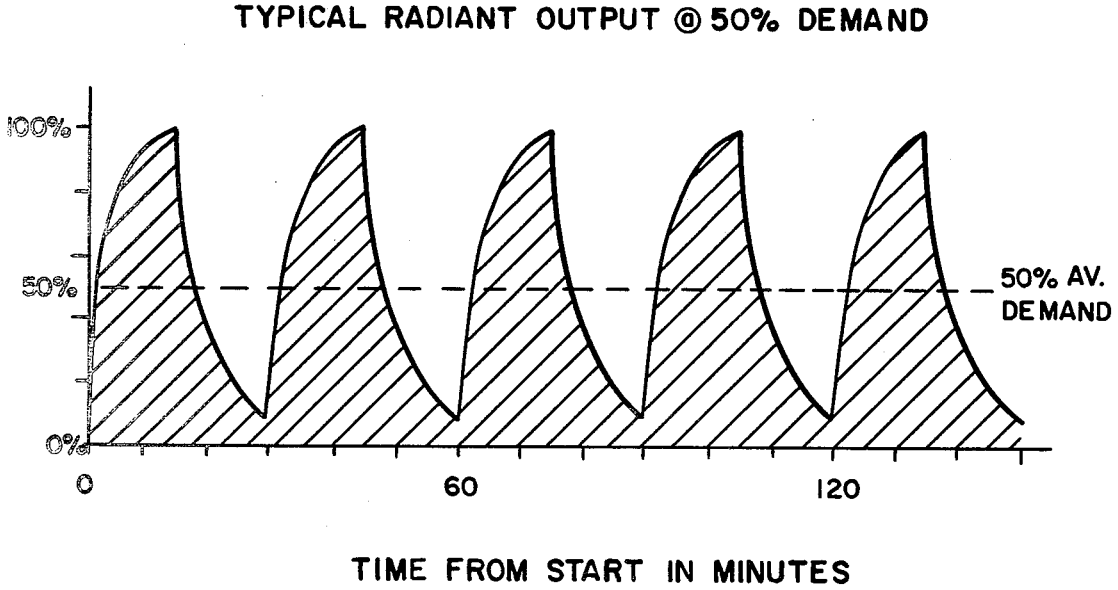
Fig. 5B.

Fig. 6A.
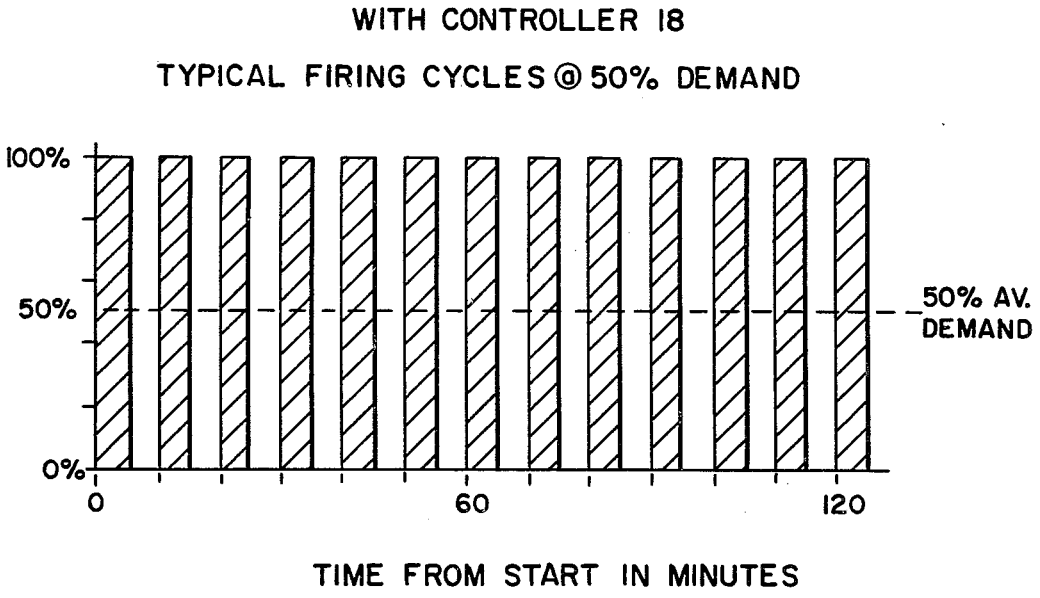
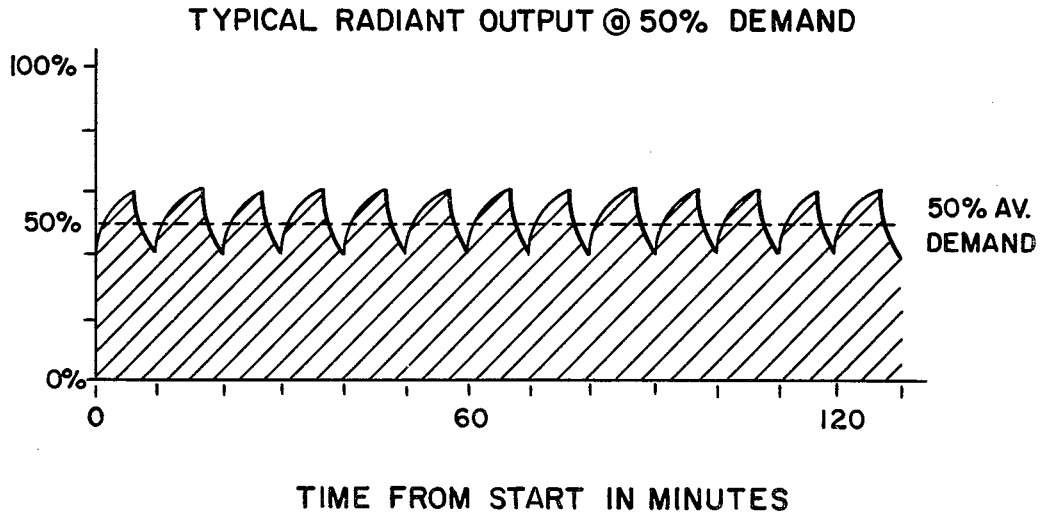
Fig. 6B.

APPARATUS AND METHOD FOR CONTROLLING THE TEMPERATURE OF A SPACE

FIELD OF THE INVENTION

The present invention relates generally to a method and apparatus for controlling the temperature of a space, and more particularly to a method and apparatus of establishing an actual heat load for a space under the conditions prevailing at the time based upon information available to a temperature sensor and adjusting the average heating/cooling percentage rate for relatively short duty cycles whereby the actual heating/cooling load during this duty cycle interval may be approximately matched.

BACKGROUND OF THE INVENTION

In most heating/cooling systems the heating/cooling unit is selected for a worse case situation. For example, a heating unit would be selected for the worse case situation, for example, minus 20° C., the actual temperature rise required for the building as compared to the design temperature rise available from the selected unit is a percentage need of approximately 50%. A normal thermostat operation may, in fact, respond by heating the building for half an hour and then being off for half an hour. However, if the cycling interval can be reduced from one hour to 10 minutes, a more uniform output of heat can be obtained which will be more closely matched to the actual heating load for the space for that particular period of time, and this is particularly true when one considers the thermal mass of most space heating systems. This is of particular interest with infrared heating systems whereby a regulated and continuous output of direct infrared radiation is necessary for maintaining comfort levels. A poor mismatch of average fuel rate over a period of a few minutes is usually not a problem for a well-designed space heating system which utilizes streams of hot air convection) or hot water (hydronic) to distribute heat to the point of use; however, it can be a problem with infrared type heating systems, particularly where the comfort level for the occupants is attempted to be maintained with the air temperatue at a lower than normal level. This can be done provided there is sufficient heat received directly by the body of the occupant by direct infrared radiation from the heating system. Since the heating system will be fired only about one-half of the time when the day is 0° C. and will be off one-half of the time, there will be little or no direct radiation during the off time to provide full comfort for the occupants. However, if the off rate can be reduced to a minimal period of time, the occupants of the space will have little perception of variations of temperature.

OBJECTS AND SUMMARY OF THE INVENTION

It is an object of the present invention to provide a method and apparatus for controlling the temperature of a space which will give the occupants of a space a perception of more uniform heating/cooling. More particularly, it is an object of the present invention to provide a method and apparatus for controlling the temperature of a space wherein the temperature of the space is constantly monitored, normal unit start/stop signals are provided when the temperature of the space attains a designated normal unit start/stop set points, establishing "on" and "off" base time periods and a plurality of unit duty cycles of a fixed relatively short duration, measuring the duration of an off period caused by receipt of a unit stop signal, and incrementally varying the duty cycle by either selecting a duty cycle of a lower unit operational time in the event that the off period exceeds the "off" base period time or selecting a duty increasing cycle of a higher unit operational time in the event that the "on" operational mode caused by a normal unit start signal exceeds the "on" base time period.

By utilizing the method and apparatus summarized briefly above, more uniform and energy efficient heating/cooling may be achieved.

Other objects and advantages of the present invention will be apparent to those skilled in the art after a consideration of the following detailed description taken in conjunction with the accompanying figures in which one preferred form of this invention is illustrated.

BRIEF DESCRIPTION OF THE DRAWINGS

FIG. 4 is a table setting forth various duty cycles.

FIGS. 5A and 5B show the typical firing cycles and radiant output, respectively, of a radiant heater when controlled by a normal thermostat without the controller of this invention, the firing cycles representing a 50% demand.

FIGS. 6A and 6B are similar to FIGS. 5A and 5B but show the firing cycles and radiant output of a heater at a 50% demand when the controller of this invention is utilized.

DETAILED DESCRIPTION

While the following description will describe the method and apparatus of this invention when utilized with periodically fired radiant gas heaters such as the direct ignition type sold under the trademark "Gordon-Ray" by the Roberts-Gordon Appliance Corp., it should be appreciated that this invention may be utilized with other forms of heating and cooling devices, although it has particular application with periodically fired radiant gas heaters.

Figure 1:
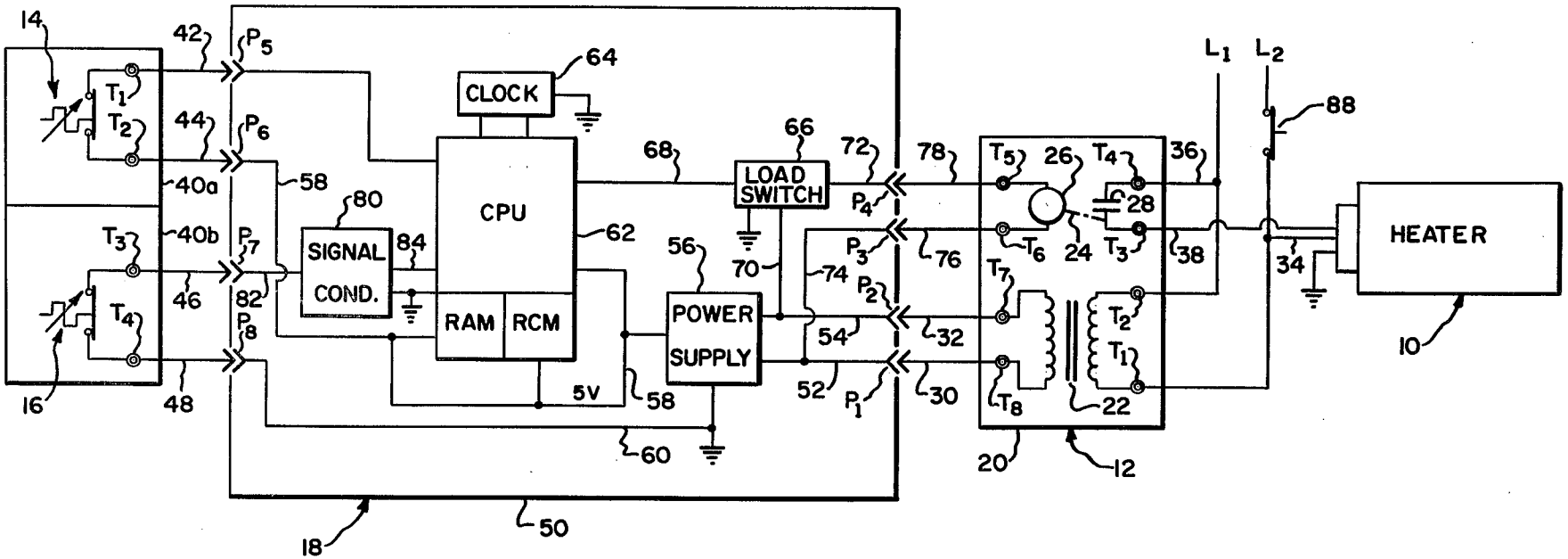
FIG. 1 is a circuit diagram illustrating how the various components of this invention are interconnected.

FIG. 1 illustrates the entire system which includes a heater indicated generally at 10, a conventional heater or furnace relay indicated generally at 12, a pair of temperature sensors or thermostats indicated generally at 14 and 16, respectively, and control means interposed between the thermostats and the heater relay, the control means or controller being indicated generally at 18. While the preferred form of heater is gas fired, its operation is in fact controlled by a switched electrical circuit which is customarily line current of 110 to 120 volts AC.

The heater relay indicated generally at 12 is of standard construction and includes an enclosure 20 which has mounted therein a step-down transformer 22 and a relay indicated by the dash dot line 24. The transformer is capable of stepping down line voltage of 120 volts to 24 volts. The relay 12 includes an actuator 26, which may be a solenoid, and a normally open switch 28 which is capable of being closed in response to actuation by the actuator 26. The enclosure 20 is provided with suitable terminals $T_1$ through $T_8$ and suitable lines may be connected to the various terminals. Thus, 120 volt lines $L_1$ and $L_2$ are connected to terminals $T_1$ and $T_2$ which are in turn connected with the input side of transformer 22. Output lines 30, 32 are in turn connected by means of terminals $T_7$ and $T_8$ to the 24 volt output side of transformer 22. Line $L_2$ may be additionally connected to the heater 10 by means of branch line 34. Similarly, line $L_1$ may also be connected to the heater through branch line 36, terminal $T_4$, switch 28 terminal $T_3$ and branch line 38.

The temperature sensors 14, 16 are shown in separate but joined together enclosures 40*a*, 40*b*. However, they could be mounted in a single common enclosure. While thermostats are shown for the temperature sensors, other forms of temperature sensing devices could be utilized. In the embodiment illustrated a normal temperature thermostat is illustrated which is interconnected with a heater 10, the thermostat including a switch 14 which will be closed when the temperature of the space surrounding the enclosure 40*a* attains or falls below a designated normal start set point for the unit 10. Similarly, the temperature responsive switch 14 will be opened when the temperature of the space surrounding the enclosure 40*a* attains or exceeds a designated stop set point for the unit 10. As this is the function of a conventional thermostat, it will not be described further. In addition, a second abnormal temperature sensor or thermostat 16 is provided, which thermostat will close initiating an abnormal temperature setting when the temperature of the space surrounding the enclosure 40*b* attains or falls below an abnormal set point condition. This thermostat will in turn open after the temperature surrounding the enclosure 40*b* is no longer abnormal as evident by an increase in temperature to exceed the abnormal set point.

In conventional thermostat design for a heating unit, the designated normal start set point will be set at a certain figure, say for example 66° F. This thermostat will close when the temperature about the enclosure 40*a* falls below the normal start set point. Similarly, the contacts of the thermostat 14 will open when the space surrounding the enclosure then attains or exceeds the temperature of the designated stop set point.

The enclosures 40*a* and 40*b* are provided with terminals $T_9$, $T_{10}$, $T_{11}$, and $T_{12}$. Signal lines 42, 44, 46 and 48 are connected respectively to these various terminals.

It should be observed that the structure described up to this point, with the exception of the abnormal temperature sensor 16, is essentially conventional. Thus, in a normal situation the lines 42 and 44 would be interconnected with the 24 volt power supply 30, 32 on the one hand and with the actuator 26 on the other hand. The actuator 26 would cause switch 28 to close when the temperature about the enclosure 40*a* attains or falls below the normal start set point of the thermostat 14, as the contacts of the thermostat 14 would close at this point. Similarly, current flow through the actuator 26 would be interrupted when the temperature about the enclosure 40*a* rises the designated stop set point, as the contacts of the thermostat 14 would open at this point causing the switch 28 to open. When the switch 28 is closed, the heater will be caused to be operated; and when it is open, the heater operation will be stopped.

In order to more uniformly heat the space which surrounds the enclosure 40, the controller 18 of this invention is functionally interposed between the temperature sensing means 14 and 16 and the heater relay 12. The control means or controller 18 includes an enclosure 50 in which are mounted various functional elements and interconnecting lines. In addition, a number of plugs are provided, these being identified at $P_1$ through $P_8$. Plugs $P_1$ and $P_2$ interconnect the 24 volt power supply with one end of internal lines 52 and 54, the other ends of which are in turn connected to an internal controller power supply indicated at 56. The internal power supply changes the 24 volt input to a 5 volt DC power supply. The power supply 56 is connected to output lines 58 and 60, line 58 being the 5 volt output line, and line 60 being grounded.

Also mounted within the enclosure 50 of the controller is a microcomputer indicated at 62, the microcomputer in turn including a central processing unit (CPU), a read-only memory (ROM) and a random access memory (RAM). An external clock indicated at 64 is suitably interconnected with the CPU of the microcomputer 62. The microcomputer is suitably programmed in a manner which will be discussed below.

A load switch indicated at 66 is also provided within the controller, the load switch being capable upon actuation from the CPU through line 68 of completing a circuit between a branch line 70 and plug line 72 which terminates in plug $P_4$. As can be seen from an inspection of FIG. 1, when the load switch closes, a circuit is then completed between the 24 volt lines 52 and 54 through plug line 74, plug $P_3$, relay line 76, terminal $T_6$, actuator 26, terminal $T_5$, relay line 78, plug $P_4$, plug line 72, load switch 66, and branch line 70. The line 68 is caused to transmit a signal to load switch 66 in response to signals received from the temperature sensors 14 and 16 and furthermore in accordance with a certain operational procedure or program contained within the microcomputer 62.

As the signals received by the CPU from the temperature sensors 14 and 16 may need to be conditioned for the proper operation of the microcomputer a signal conditioner may be provided, one such signal conditioner being indicated at block 80. The signal conditioner is in turn interconnected with plug $P_7$ by plug line 82 and with the CPU by a further line 84. In the event that signal conditioning may not be required, the temperature sensor may be connected directly to an input of the CPU as for example by line 86 which extends between plug 52 and a suitable connection on the CPU of the microprocessor. As is customary the various elements within the controller 18 are grounded, and thus the CPU, RAM, ROM, signal conditioner, clock, and load switch all may be grounded as indicated in FIG. 1.

Figure 2:
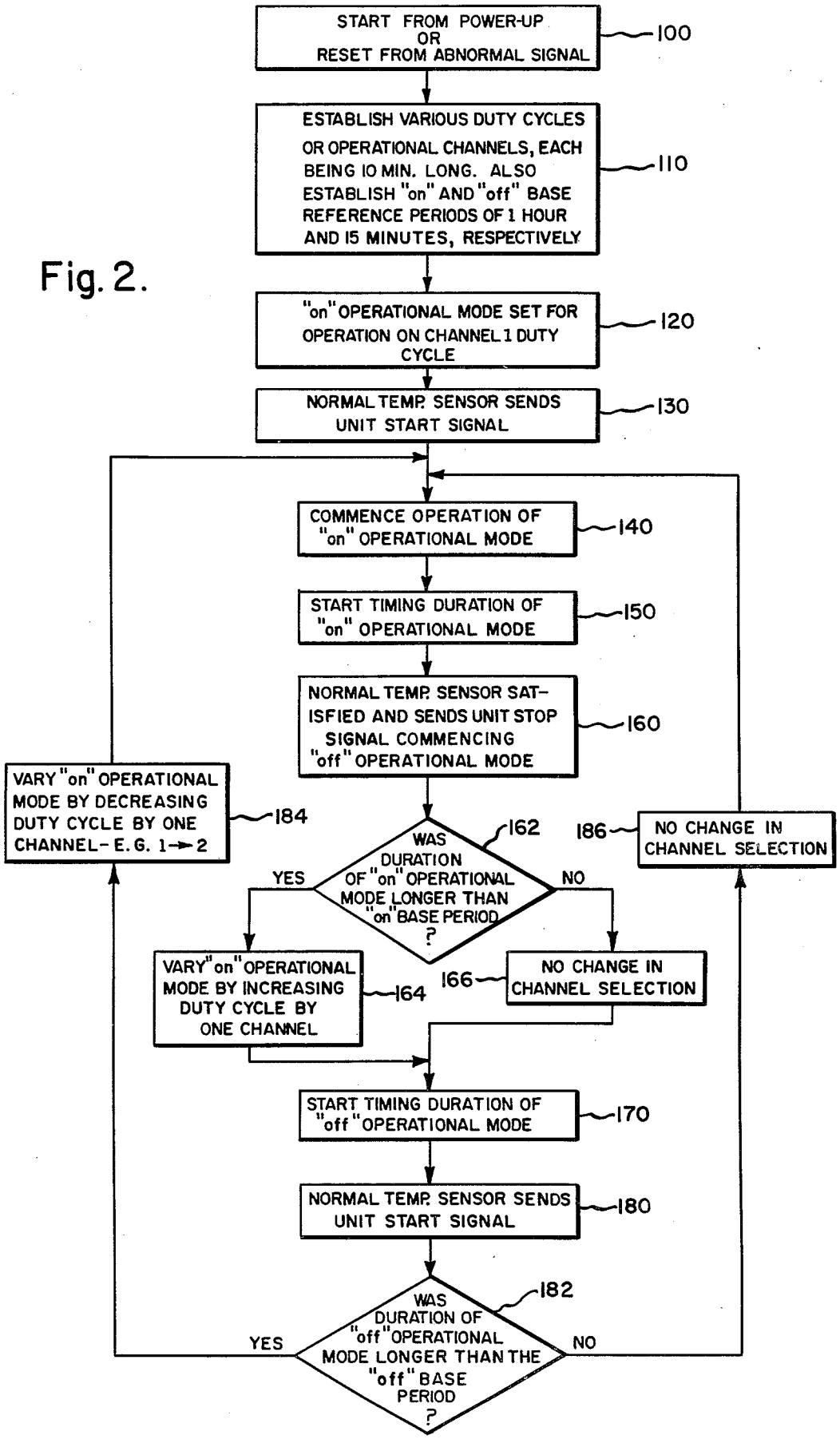
FIG. 2 is a flow chart illustrating the program embodied within the controller.
Figure 3:
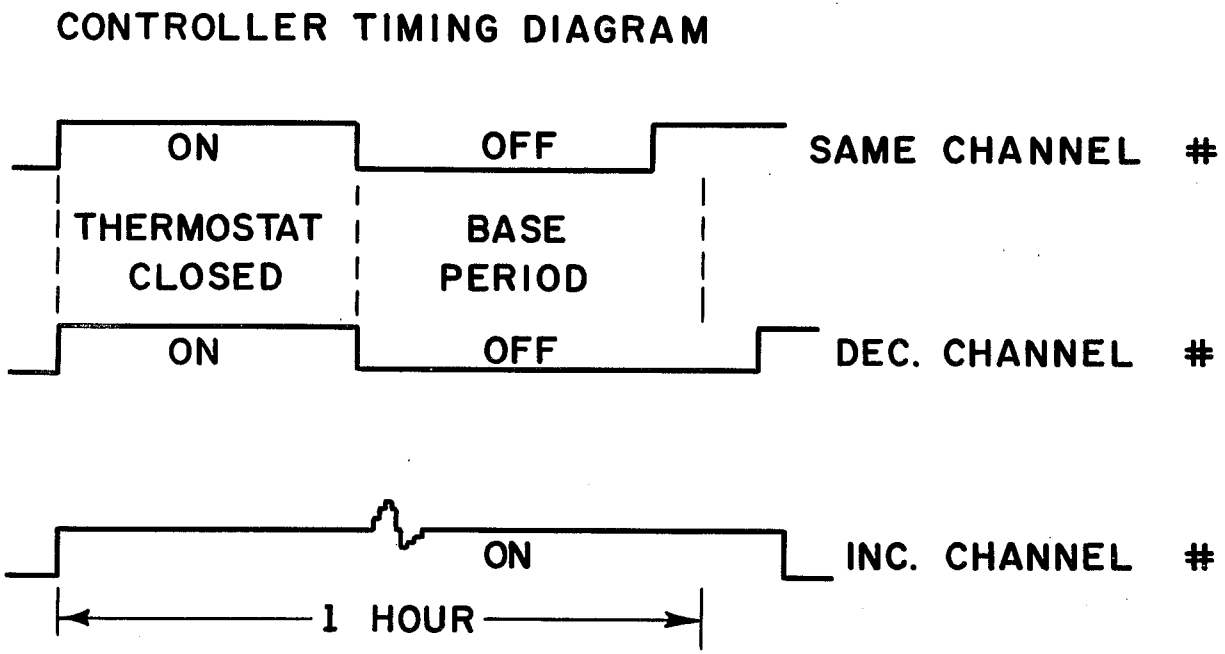
FIG. 3 is a controller timing diagram.
Figure 7:
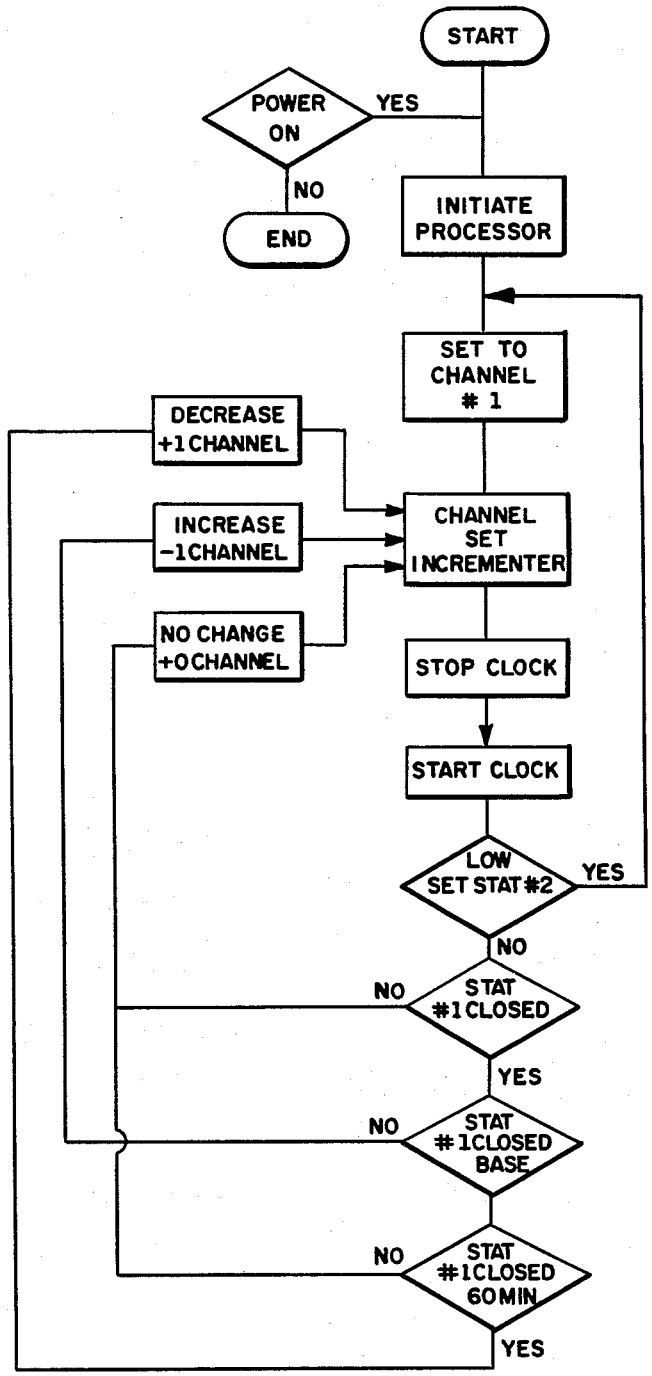
FIG. 7 is a circuit logic diagram.

The operation of the system illustrated in FIG. 1 can best be appreciated from an inspection of the flow chart in FIG. 2, the controller timing diagram in FIG. 3, and the duty cycle table set forth in FIG. 4. First, it should be observed that the microcomputer 62 is provided with a program which controls its operation. This program will cause the microcomputer to commence an "on" operational mode in receipt of a start signal from the normal temperature sensor 14 and to comence an "off" operational mode in receipt of a stop signal from thermostat 14. The program will also cause the microcomputer to establish various duty cycles or operational channels, each duty cycle being of the same predetermined length of time. In the embodiment illustrated 10 duty cycles or operational channels are established, these being illustrated in the table of FIG. 4. Channel No. 1 will cause the load switch 66 to be closed 100% of the time during each complete duty cycle of operation. Thus, for a complete duty cycle of 10 minutes, which is that selected for the system shown in FIG. 1, the load switch will be closed 100% of the time. However, duty cycles are only commenced when an "on" operational mode is started, and are terminated when an "off" operational mode is started. Thus, if the microcomputer enters an "off" operational mode seven minutes after the start of the duty cycle, the cycle will be terminated. Similarly, if the microcomputer enters an "off" operational mode 40 minutes after the start of a duty cycle, 4 duty cycles will time out. Channel No. 2 will cause the load switch to be closed 95% of the time during each complete duty cycle. Thus, again with reference to a 10 minute duty cycle, if channel 2 operation is selected, the load switch will be closed 9.5 minutes and will be open 0.5 minutes. Similarly, channel 3 will cause the load switch to be closed during each complete duty cycle of operation 8.5 minutes and to be open 1.5 minutes.

The program, in addition will also establish "on" and "off" base reference periods. The "on" base reference period in the preferred embodiment is 1 hour. The "off" base reference period in the preferred embodiment is 15 minutes.

The program will also cause channel selection to be varied after the operation of the initial cycle in accordance with the program outlined in the flow chart of FIG. 2. Referring now in more detail to the program, the operation of the controller 18 and its microcomputer 62 is initiated customarily by the closing of a line switch which can be switch 88 as shown in FIG. 1. However, operation can also be initiated by any power up condition which could be, for example, resumption of power to the system after a power failure. Initial operation can also be initiated by the receipt of an abnormal unit start signal received from the abnormal temperature sensor 16. The start or reset condition is indicated by block 100 in the flow chart.

Block 110 indicates that various duty cycles or operational channels are established by the program within the microcomputer 62, the duty cycles being 10 minutes long, and also that "on" and "off" base reference periods of 1 hour and 15 minutes, respectively, are established.

Once the controller 18 is powered up or reset the "on" operational mode will be set for operation on channel 1 duty cycle. This is represented by block 120.

Once the initial "on" operational mode of the controller has been set, its operation will not be commenced until the normal temperature sensor 14 sends a unit start signal to the microcomputer 62. It should be noted that in the event that there is a reset, the normal temperature sensor will simultaneously send a unit start signal commencing the "on" operational mode of the controller. The initiation of a start signal is represented by block 130, and the commencement of operation of the "on" operational mode is represented by block 140.

Once the operation of the unit has been initiated by the normal temperature sensor sending a unit start signal, the length of time which the controller is in the "on" operational mode is measured. This is indicated by block 150.

The heater unit will customarily be fired during the operation of the controller in accordance with the selected channel. Thus, when at startup or reset, the heater will be operated during 10 minutes of each duty cycle of 10 minutes or 100% of the time. However, after a number of cycles of operation a differing channel may have been selected by the program, and accordingly the heater may only be operating at a 55% duty cycle (channel 6) wherein it will be fired for 5.5 minutes of each duty cycle and be off 4.5 minutes of each duty cycle. In any event, when the thermostat 14 is satisfied, it will open causing a unit stop signal to be transmitted to the microcomputer 62. This will immediately cause the load switch 66 to open (if not already open) interrupting operation of the unit 10. This is represented by block 160.

Once the unit stop signal is sent by the normal temperature sensor 14, a comparison is made, this comparison being indicated by the decision block 162. If the duration of the unit start signal was longer than the "on" base period of 1 hour, the "on" operational mode is reset by increasing the duty cycle by 1 channel. Thus, for example, if the last channel to have been operated was channel 2, channel 1 operation is then selected. This is represented by block 164. On the other hand, if the duration of the unit start signal was not longer than the "on" base period of 1 hour, then there will be no change in channel selection and this is represented by block 166.

Immediately after the microcomputer 62 receives a unit stop signal from the normal thermostat 14, which signal can be merely an open line in the embodiment illustrated, the microcomputer 62 starts timing the duration of the "off" operational mode. This is indicated by block 170 in the flow chart of FIG. 2. During the time that the microcomputer 62 is in its "off" operational mode the load switch 66 will be held in open condition thereby preventing operation of the heater 10. This condition will prevail until the normal temperature sensor sends a unit start signal which would happen when the contacts of thermostat 14 are closed. This is indicated by block 180.

Immediately after receipt of a unit start signal a comparison is made between the duration of the "off" operational mode and the established "off" base time period. If the duration of the "off" operational mode was longer than the "off" base time period, then the "on" operational mode is reset by decreasing the duty cycle by one channel, for example from 1 to 2. This decision process is indicated by block 182, and the response to a yes answer is indicated by block 184. In the alternative, if the duration of the "off" operational mode was not longer than the "off" base time period, then there would be no change in the channel selection, and this is represented by block 186.

At this point the program loops, and the microcomputer 62 immediately commences operation of the "on" operational mode in the last selected channel and also starts timing the duration of the "on" operational mode, this being represented by blocks 140 and 150.

While the operation of the system described above has been related to a heater, it should again be noted that other forms of units for controlling the temperature of a space could be utilized. For example, the unit 10 could be a refrigeration unit, and the temperature sensors 14 and 16 could respectively sense the normal desired operating range and a high temperature abnormal setting. While various times have been set forth, these are based upon experience using a periodically gas fired radiant heater of the type referred to above. The durations of the duty cycles and the "on" and "off" reference periods have been established with reference to a normal installation of such a heater. Obviously, other periods could be utilized with other forms of heaters or refrigeration units. However, the particular times specified have been found to have beneficial results when employed with the system utilizing the periodically fired gas radiant heater of the type referred to. Because of the thermal mass of locus whose temperature is being modified by the unit 10, it has been found that the "on" base period should be approximately four times the length of the "off" base period.

Referring now to FIGS. 5 and 6, the advantage of this invention when utilized with a radiant heater can be appreciated. Thus, in a normal controlled situation at a 50% demand level for the area about the thermostat the heater would typically cycle on for 15 minutes and off for 15 minutes. As can be seen from FIG. 5B the radiant output of the heater would initially increase to almost a 100% level during the on portion of a firing cycle and then progressively decrease towards a zero output during the off period of time. Thus, within a short period of time after the heater has been turned off it is not putting out a sufficient output to warm the surrounding area. However, when utilizing this invention, as illustrated in FIG. 6, it can be seen that there is a much more uniform output of heat from the radiant heater when the firing cycles and off cycles are of shorter duration. Thus, the heater is constantly putting out heat at levels which approximate a 40%–60% range of potential heater output thus leading to a much more satisfactory heating condition within the area heated by the radiant heater.

In summary, it should be noted that the controller extracts information about the actual demand on the heating system, and it does this by measuring the length of time that the thermostat is satisfied between the calls for heat by the thermostat. This information is then converted by the microcomputer into an adjustment of the duty cycle to automatically adjust the firing time of each base period (10 minutes). This is done in a way to match the firing time in each 10 minute period to equal about 110% of the actual demand. The thermostat 14 will provide the necessary control of the firing time to provide a more precise match of the firing time (heat gain) to the demand (heat loss). The above is accomplished without the use of a sensor to indicate outside temperature as would be required with conventional equipment to perform the same task. Thus, the system will obtain information that is adjusted to the actual conditions or changes such as an open window, extra ventilation, etc.

While the preferred design in which the principles of the present invention have been incorporated is shown and described above, it is to be understood that the invention is not to be limited to the particular details shown and described above, but that, in fact, widely differing means may be employed in the practice of the broader aspects of this invention.

What is claimed is:

1. Apparatus for controlling the temperature of a space; said apparatus comprising:

a periodically operated unit capable of modifying the temperature of a space:

a normal temperature sensor capable of sensing the temperature of said space and of providing either a normal unit start signal when the temperature of the space attains a designated normal start set point for the unit or a unit stop signal when the temperature of the space attains a designated stop set point for the unit; and control means operationally interconnected with said unit and said normal temperature sensor and capable during operation of the control means of establishing "on" and "off" base time periods and a plurality of unit duty cycles of varying percentages of unit operational time commencing an "on" operational mode when said control means receives a normal unit start signal, the unit being caused to operate at one of said plurality of unit duty cycles during an "on" operational mode, the initial "on" operational mode after startup being at an initial duty cycle of 100%, and also commencing and "off" operational mode when said control means receives a unit stop signal, the unit being caused to not operate during an "off" operational mode, comparing the duration of "on" and "off" operational modes with the "on" and "off" base time periods, respectively and varying the unit duty cycle by reducing the percentage of unit operational time if the duration of the "off" operational mode exceeds the "off" base time period and increasing the percentage of unit operational time if the duration of the "on" operational mode exceeds the "on" base time period.

2. The apparatus as set forth in claim 1 wherein the unit duty cycles are varied incrementally.

3. The apparatus as set forth in claim 1 wherein said plurality of unit duty cycles include a plurality of channels, each channel establishing a fixed percentage of unit operational time, and the plurality of channels having incrementally spaced apart percentages of unit operational time.

4. The apparatus as set forth in claim 3 wherein 10 separate channels are provided, the first channel causing the unit duty cycle to be 100%, the second channel causing the unit duty cycle to be 95%, the third channel causing the unit duty cycle to be 85%, and each succeeding channel causing the unit duty cycle to be 10% less than the prior unit duty cycle.

5. The apparatus as set forth in claim 4 wherein each unit duty cycle is of 10 minutes duration.

6. The apparatus as set forth in claim 1 wherein each unit duty cycle is 10 minutes.

7. The apparatus as set forth in claim 1 wherein the "on" base time period is substantially longer than the "off" base time period.

8. The apparatus as set forth in claim 7 wherein the "on" base period is approximately of 1 hour duration, and the "off" base period is of approximately a 15 minute duration.

9. The apparatus as set forth in claim 1 wherein the control means includes a programmed microcomputer.

10. The apparatus as set forth in claim 1 further characterized by the provision of an abnormal temperature sensor capable of sensing the temperature of said space and of providing an abnormal temperature signal when the temperature of the space attains a designated abnormal set point and said control means additionally being operationally interconnected with said abnormal temperature sensor and further being capable during operation of the control means of commencing an "on" operational mode of 100% duty cycle when said control means receives an abnormal temperature signal from said abnormal temperature sensor.

11. The apparatus as set forth in claim 10 wherein said unit is a furnace.

12. The apparatus as set forth in claim 11 wherein said abnormal temperature sensor is a low temperature sensor.

13. The apparatus as set forth in claim 1 further characterized by the provision of a unit relay operationally interposed between said control means and said unit, said relay being interconnected with line voltage, said control means being capable of causing the relay to close at the commencement of an "on" operational mode and to selectively open and close during the "on" operational mode in response to selected unit duty cycles and also being operable to cause the relay to open upon commencement of an "off" operational mode.

14. A microcomputer based controller for controlling the temperature of a space which is modified by a periodically operated temperature modifying unit, there being a normal temperature sensor capable of sensing the temperature of said space and providing either a unit start signal when the temperature of the space attains a designated normal unit start set point or a unit stop signal when the temperature of the space attains a designated stop set point for the unit, said microcomputer based controller being operationally interconnected with said unit and said normal temperature sensor: said controller comprising a load switch interconnectible with a temperature modifying unit and a power supply; and a microcomputer interconnected with the load switch and capable of causing said load switch to be switched between on and off states, said microcomputer further being capable of establishing "on" and "off" base time periods and a plurality of unit duty cycles of varying percentages of unit operational time, commencing an "on" operational mode when said control means receives a unit start signal, the load switch being caused to operate at one of said plurality of unit duty cycles during an "on" operational mode, the initial "on" operational mode after startup being at an initial duty cycle, and also commencing an "off" operational mode when said control means receives a unit stop signal, the load switch being open during an "off" operational mode, comparing the duration of "on" and "off" operational modes with the "on" and "off" base time periods, respectively, and varying the unit duty cycle by reducing the percentage of unit operational time if the duration of the "off" operational mode exceeds the "off" base time period and increasing the percentage of unit operational time if the duration of the "on" operational mode exceeds the "on" base time period.

15. A method of controlling the temperature of a space which is heated by a periodically operated unit, said method comprising the following steps:

sensing the temperature of said space and providing either a normal unit start signal when the temperature of the space attains a designated normal unit start set point or a unit stop signal when the temperature of the space attains a designated stop set point for the unit;

establishing "on" and "off" base time periods and a plurality of unit duty cycles of varying percentages of unit operational time;

commencing an "on" operational mode in response to a normal unit start signal, the unit being operating at one of said plurality of unit duty cycles after an "on" operational mode has been commenced in response to a normal unit start signal, the initial "on" operational mode in response to the initial normal unit start signal being an initial duty cycle, and also commencing an "off" operational mode in response to a unit stop signal, the unit not being operated during an "off" operating mode;

comparing the duration of "on" and "off" operational modes with the "on" and "off" base time periods, respectively; and varying the unit duty cycle by reducing the percentage of unit operational time if the duration of the "off" operational mode exceeds the "off" base time period and increasing the percentage of unit operational time if the duration of the "on" operational mode exceeds the "on" base time period.

16. The method as set forth in claim 15 wherein the unit duty cycles are varied incrementally.

17. The method as set forth in claim 15 wherein the on base time period is established to be approximately four times the length of an off base time period.

18. The method of claim 15 wherein unit duty cycle is established to be less than the off base time period.

19. The method as set forth in claim 15 comprising the additional step of sensing the temperature of said space and providing an abnormal unit start signal when the temperature of the space attains a designated abnormal unit start set point; and commencing an "on" operational mode of 100% after receipt of said abnormal unit start signal.

20. The method as set forth in claim 19 wherein the abnormal unit start set point is at a temperature lower than the normal unit start set point.

21. The method as set forth in claim 15 wherein all of the duty cycles have the same total duration, which duration does not exceed the "off" base time period.

* * * * *